US007331910B2

(12) United States Patent
Vallone et al.

(10) Patent No.: US 7,331,910 B2
(45) Date of Patent: Feb. 19, 2008

(54) PHYSICAL REHABILITATION AND FITNESS EXERCISE DEVICE

(76) Inventors: Anthony John Vallone, 3812 woodleigh Dr. NW., Canton, OH (US) 44718; John Frank Vallone, Sr., 63 Crestmont Rd., Binghamton, NY (US) 13905; John Frank Vallone, Jr., 2563 Siesta Ave., Las Vegas, NV (US) 89121

( * ) Notice: Subject to any disclaimer, the term of this patent is extended or adjusted under 35 U.S.C. 154(b) by 703 days.

(21) Appl. No.: 10/653,572

(22) Filed: Sep. 3, 2003

(65) Prior Publication Data

US 2005/0049122 A1 Mar. 3, 2005

(51) Int. Cl.
*A63B 21/00* (2006.01)
*A63B 22/00* (2006.01)

(52) U.S. Cl. ..... 482/128; 482/91; 482/111; 482/136

(58) Field of Classification Search ..... 482/91, 482/92, 111–120, 128, 133–139, 148
See application file for complete search history.

(56) References Cited

U.S. PATENT DOCUMENTS 5,062,633 A * 11/1991 Engel et al. ..... 482/118
5,454,773 A * 10/1995 Blanchard et al. ..... 482/133

* cited by examiner

*Primary Examiner*—Glenn E. Richman

(57) ABSTRACT

A dual purpose physical rehabilitation orthopedic and physical fitness exercise device for use within physical therapy facilities. The rehabilitation and exercise device includes a frame hosting a hydraulic or pneumatic system means for applying variable levels of resistance for specified exercise regimens; an activating assembly including a torsion bar, indexed platen, exercise arm assembly and a lever to act against hydraulic/pneumatic pressurized cylinders. The exercise arm assembly includes equally spaced ports and locking pins to allow altering the active length of the arm. Further, the platen contains ports, radially positioned around its facial surface to permit adjusting the angular displacement of the exercise arm through 90° either side of the horizontal. The platen also has inscribed degree indexes to define angular displacement from preset azimuth during the exercise routine.

18 Claims, 14 Drawing Sheets

PHYSICAL REHABILITATION AND FITNESS EXERCISE DEVICE

FIELD OF THE INVENTION

The present invention relates to a facility or home based, detachably installed, dual purpose as a physical rehabilitation orthopedic device and as a physical fitness exercise device having horizontal and vertical adjustment seating, attachable plinth type platforms for regimens requiring supine or prone positions, levers and adjustable resistance pneumatic or hydraulic assemblies, controls, measurements and optionally, recording capabilities.

BACKGROUND OF THE INVENTION

This invention discloses an exercise orthopedic device which allows prescribed rehabilitative physical therapy regimens to be safely applied, controlled, measured and recorded by qualified physical therapists and technicians in treatment facilities. Further, this device may be employed as a home and/or physical fitness center (health spas) permanently or detachably installed physical fitness device to develop and maintain proper muscle toning and overall physical fitness.

Weakened muscles attributed to injuries, debilitating illnesses, and surgical procedures require rehabilitative isometric as well as progressive and constant isotonic exercises to help restore strength. In the past, and currently, prescribed exercise regimens have been applied using weights, elasticized bands, serial pulley configurations and a variety of high and low tech devices and exercises to restore strength and an acceptable degree of flexibility and/or range of motion to affected muscles and orthopedic joints. Hydraulic and pneumatic exercise platforms have been employed for physical fitness as well as restorative rehabilitation therapies. In this respect, each of these devices/platforms is designed to focus on specific muscle groups and extremities. Therefore, a family of devices is required to meet total body muscular rehabilitation and physical fitness exercise regimens. Similarly, in many instances, devices designed to enhance physical fitness regimens are not fully, or safely adaptable to specific physical therapy regimens.

Currently, there are no known devices or platforms which provide a spectrum of predefined measured, controlled and recorded isometric and isotonic exercise profiles to meet the diverse and variable demands of rehabilitation and physical fitness exercise regimens.

PRIOR ART

A significant number of hydraulic, pneumatic, mechanical and suspended weight machines have been designed and patented to meet physical fitness and rehabilitation therapy requirements. These machines, activated by levers and/or pulley systems, are generally defined as variable resistance exercise or physical fitness devices offering a full spectrum of rehabilitative and physical fitness capabilities. However in evaluation, it becomes apparent that due to user accommodations and design configurations these devices are not adaptable to the full spectrum of physical fitness and rehabilitation exercise regimens. Each device however, provides a platform to perform designated exercise routines for individual body parts and muscle groups. A plurality of complementary devices would be required to meet the full spectrum of exercise routines for both physical fitness and physical rehabilitation purposes.

Representative adjustable resistance exercise devices employing mechanical means of resistive forces include:

U.S. Pat. No. 4,757,993 to Rake which defines a mechanical exercise device employing adjustable lever arms and prestretched springs to provide variable levels of resistance.

U.S. Pat. No. 5,842,961 to Davis employs pulleys and weights to provide the adjustable resistance levels required for the regimens of rehabilitation therapy and exercise routines.

U.S. Pat. No. 6,494,819 to Borland defines an exercise device based on employment of a plurality of resilient masts, each of which when installed, provides a greater or lesser level of resistive forces for abdominal, obliques and calf-soleus muscles.

These representative devices, and other similarly configured and related mechanical exercise and rehabilitation devices, lack the flexibility and adaptability to accommodate the spectrum of rehabilitation and exercise regimens as applicable to all body muscular and skeletal groups. Additionally, the use of weights, prestretched springs, resilient masts or any other static friction or resistance devices do not provide the degree of finite resistance measurements and adjustments necessary for effective rehabilitation therapy.

Representative adjustable resistance rehabilitation and exercise devices employing pulleys, cables and pneumatic and/or hydraulic systems of resistive forces include:

U.S. Pat. No. 4,691,918 to Rockwell defines a system of cables and pulleys employed to engage the exercise device's resistance components which may be weights, pneumatic, devices, elastic resistance elements or any other variable resistance devices. Similarly, U.S. Pat. No. 6,491,610 to Henn defines a variable resistance type exercise device which also employs cables variably attached along the length of a set of levers.

While these representative, and similarly configured and related, devices have application to a limited regimen of exercise and rehabilitation therapy a major deficiency focuses on the indirect activation of the levers and hydraulic/pneumatic resistance systems through a network of pulleys and/or cables. This deficiency highlights the limitations of the devices to be adaptable to the varied exercise body profiles which include exercises in the standing, sitting and supine or prone positions. Additionally, cable activated exercise devices are not readily adaptable to all extremities and prime muscular groups which are physical fitness and rehabilitation exercise targets. A third limitation of cable activating systems is the lack of rigidity and direct inflexible interface between the exerciser and the machine for positive control of movement throughout the exercise routine.

A significant number of devices employing pneumatic systems to provide adjustable resistive forces to meet physical fitness and/or rehabilitation exercise requirements are defined in the index of U.S. Patents. The devices using pneumatic systems identified below provide a baseline of similar type devices which have received U.S. patents. These representative devices include:

U.S. Pat. No. 4,227,689 to Keiser defines a leg exercise device employing an adjustable resistance pneumatic system comprised of a compressor, control panel with a pressure regulator and gauge, a pair of plunger activated pneumatic valves, single stroke pneumatic cylinders and air reservoir tanks and an exercise member consisting of linkage, lever and exercise pad mounted for movement along a curved path.

U.S. Pat. No. 4,257,593 to Keiser defines a "weight type" exercise device which employs a similar pneumatic system, levers and linkage for controlling resistance levels for the exercise device. This device allows "weight type" exercise routines employing arm movement of the exercise member from either a standing, sitting or supine position.

Similarly, U.S. Pat. No. 4,397,462 to Walmarth, U.S. Pat. No. 4,728,101 to King, and U.S. Pat. No. 4,911,436 to Lighter, define variations of pneumatic exercise devices configurations basically similar to those patents to Keiser, as defined above. The primary limitations of these devices, collectively, is their lack of flexibility and adaptability to a full spectrum of fitness and rehabilitation exercise regimens.

A significant number of hydraulically controlled resistance exercise devices, each device being a variation of pneumatic devices identified above, have also been reviewed and a representative listing of these devices is provided below:

U.S. Pat. No. 6,413,195 B1 to Barzelay discloses a passive/active hydraulic exercise device which may be selectively operated in either a push or pull resistive mode. The passive and active modes of operation provide adaptability and functionality for both physical fitness and physical rehabilitation regimens. However, due to the physical profile of the base unit hosting the hydraulics system, the adaptability of this device appears limited to upper body, shoulder and arm exercises.

U.S. Pat. No. 4,363,481 to Erickson discloses an adjustable resistance hydraulic system driven weight lifting device employing a double acting hydraulic cylinder to provide resistive forces in a direction opposite to the direction of the applied exercise forces. This device is designed to be applicable to weight lifting exercise regimens and has little, if any, adaptability to rehabilitative exercise regimens or development of lower body and legs exercise requirements. However, the adjustable resistance hydraulic system has applicability and adaptability to a wide range of physical fitness and rehabilitation exercise devices.

U.S. Pat. No. 4,448,412 to Brentham discloses an exercising device with a self contained adjustable resistance double acting hydraulic cylinder. While the exercise device, same as others, is limited in its application to a wide variety exercise and rehabilitation exercise routines. However, the self contained adjustable resistance hydraulic cylinder has universal application to a variety exercise and rehabilitation devices.

U.S. Pat. No. 5,505,281 to Lee, U.S. Pat. No. 4,651,986 to Wang and U.S. Pat. No. 4,291,787 to Berntham disclose self contained remote control adjustable hydraulic cylinders which are particularly adaptable for use with exercise machines.

Self contained and comprehensive compressor activated hydraulic cylinders are also disclosed throughout the numerous patented exercise devices. Particularly, applications of self contained adjustable resistance are readily disclosed within various patented stepper exercise machines. These hydraulic systems are for the most part fully adaptable to both physical fitness and physical rehabilitation exercise devices.

OBJECTS AND SUMMARY OF THE INVENTION

The principle objective of this invention is to provide a device/platform to apply iterative cycles of predefined and preset measured and controlled stress levels for constant isotonic resistance exercise regimens that involve overloading muscles to build strength for therapeutic as well as physical fitness applications. It is also the objective of this invention to provide a device/platform which is fully adaptable to rehabilitation, health club and home exercise facilities; is adaptable to use by individuals (with proper instruction and training) as well as trained therapy technicians, and which can be manufactured and constructed economically.

Accordingly, the present invention includes use of two (2) major substructures, the first of which is a main frame hosting either an adjustable resistance hydraulic cylinder or a pneumatic system with appropriate pressure adjustment and readout components, a bearing mounted lever assembly, a platen configured with inscribed degree indexes, radial repositioning ports on a vertical plane, and an adjustable length exercise arm to work against the selected hydraulic or pneumatic components preset resistance levels.

The second major assembly is comprised of a mechanical, pneumatic or hydraulic vertical adjustment seat mounted on a wheeled platform, with a locking mechanism, and mated to parallel tracks which provide horizontal adjustment/positioning of the seat to accommodate patient/user for various fitness and rehabilitation exercise profiles. A plinth assembly is provided to mate with the seat to provide a horizontal platform for exercises which require the patient/user to be in a supine or prone position.

A dynamometer, with optional off-the-shelf computer and software programs to record achieved levels of exercise stresses, is provided to measure forces applied during the specified exercise regimens. Further, the dynamometer serves an additional function of validating and calibrating the adjustable pressure (stress) levels of the hydraulic and/or pneumatic cylinders. This is especially critical when considering that the extension or contraction of the exercise arm, alters the dynamics of stresses by increasing or decreasing the length of the exercise arm (lever). However, full extension of the exercise arm still keeps the stress levels within reasonable and realistic target span for physical rehabilitation routines.

These assemblies comprise the embodiment of the physical rehabilitation and fitness exercise device which provides controlled and measurable resistance forces and range of motion deflections for a broad spectrum of isometric as well as constant, repetitive and progressive isotonic exercise regimens. The preferred embodiment includes options for either a compressor driven hydraulic or pneumatic systems (Refer to FIG. 1) or alternatively as a self contained adjustable resistance hydraulic driven system (Refer to FIG. 1A) to provide predefined and preset variable levels of resistance depending on the environment within which the devices will be operated as well as for the purposes for which the devices will be used.

Pneumatic systems may employ either ganged multiple devices serviced by a large centralized compressor, as applicable to spa environments, or with individual self contained compressor and cylinder configurations as would be applicable to rehabilitation therapy facilities or home exercise environments as depicted in FIG. 17.

Hydraulic systems would be better adapted to individual exercise devices for home and rehabilitation therapy facilities. The hydraulic system may be configured with a compressor and cylinder as depicted in FIG. 18 or as an off-the-shelf self contained adjustable resistance hydraulic cylinders as disclosed in a number of U.S. patents including U.S. Pat. Nos. 4,651,986, 4,448,412, 4,291,787 and 5,505,281.

DETAILED DESCRIPTION

Figure 1A:
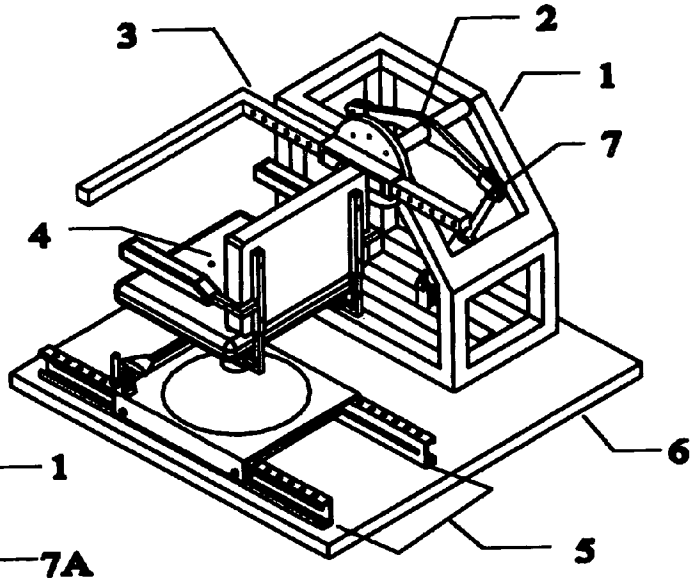
FIG. 1A is an oblique projection of the Physical Rehabilitation and Fitness Exercise Device configured with an adjustable resistance hydraulic cylinder.
Figure 1:
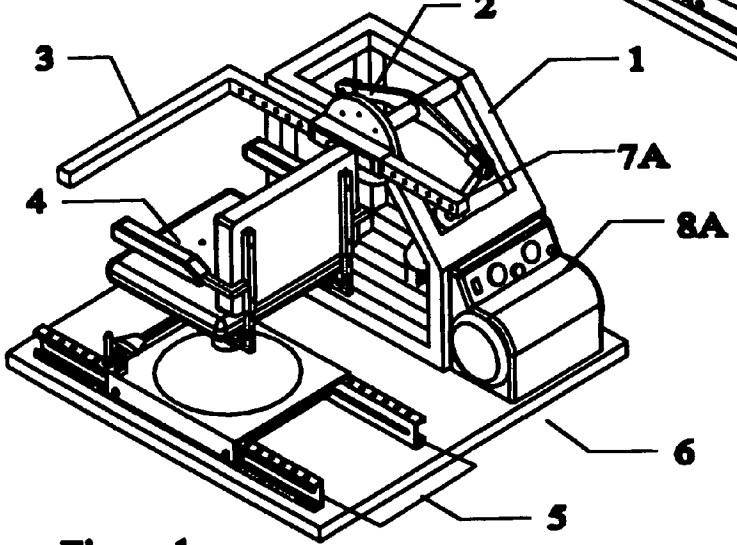
FIG. 1 is an oblique projection of the Physical Rehabilitation and Fitness Exercise Device configured with a self contained variable resistance oil free pneumatic compressor and pneumatic cylinder.
Figure 2:
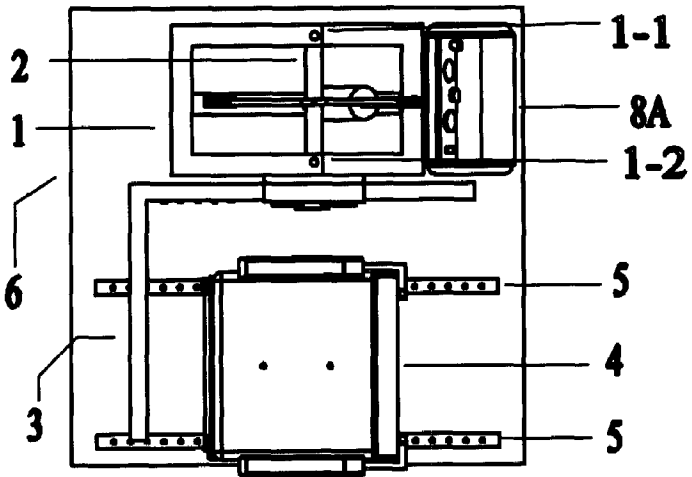
FIG. 2 is the top view of the Physical Rehabilitation and Fitness Exercise Device depicting configuration with the self contained pneumatic compressor.
Figure 3:
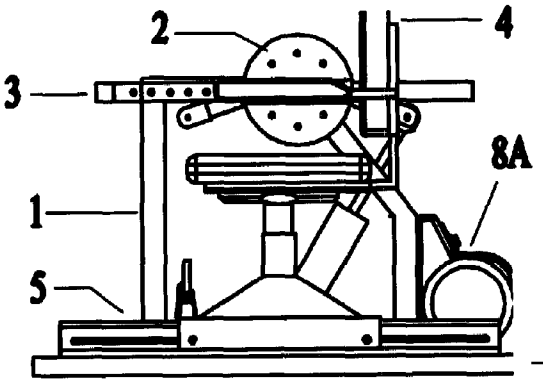
FIG. 3 is the side view of FIG. 2.
Figure 4:
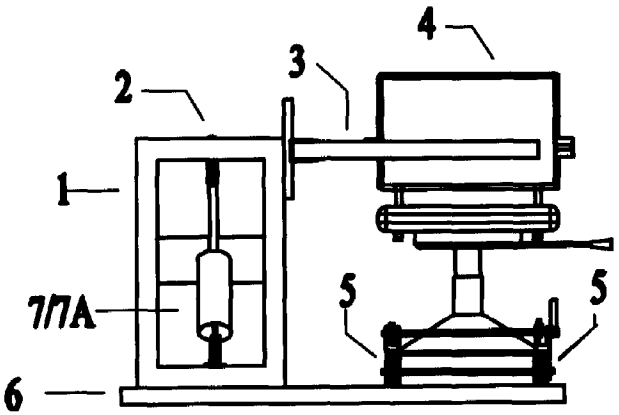
FIG. 4 is the front view of FIG. 2 with annotation defining both the hydraulic (7) and pneumatic (7A) cylinders.

As depicted in the drawings (FIG. 1 through FIG. 18) the preferred embodiment of the Physical Rehabilitation and Fitness Exercise Device (hereinafter referred to as the Rehabilitation and Exercise Device), in accordance with this invention, includes the main frame assembly 1, the seat assembly 4, tracks 5 and virtual platform 6. The main frame and seat assemblies are detachably mounted to a solid platform, or flooring, as depicted herein as the virtual platform 6. Referring to FIGS. 1 through 4, the main frame 1 assembly is comprised of three (3) subassemblies; the torsion bar subassembly 2, the exercise arm subassembly 3 and optionally, either a pneumatic or hydraulic compressor and connectors 8A and a pneumatic or hydraulic cylinder 7A, as depicted in FIG. 1, or alternatively a self contained adjustable resistance hydraulic cylinder 7, as depicted in FIG. 1A to provide controlled levels of resistance for the Physical Rehabilitation and Exercise Device. Set screws 1-1 (2 each) and 1-2 (2 each), as shown in FIG. 2 located on the upper and lower surfaces of the top frame bar, retain the torsion bar bearings which are depicted in FIG. 10.

The optional variable and adjustable resistance components configurations permit adaptation of this device to a variety of environments ranging from the home to physical therapy facilities and to physical fitness spas. The adjustable resistance hydraulic cylinder configuration may be optionally configured as a compressor driven unit as depicted in FIG. 1 and as schematically defined in FIG. 18, or alternatively as a stand alone self contained adjustable resistance hydraulic cylinder of the types as defined in U.S. Pat. No. 4,448,412 to Brentham and U.S. Pat No. 5,505,281 to Lee. This configuration is readily adaptable to home and physical rehabilitation facilities.

The pneumatic cylinder configuration could be optionally equipped as a stand-alone device or as ganged series of devices. As a stand-alone device the configuration will include an integrated and dedicated compressor (as depicted in FIG. 1). As a ganged device, its' configuration would include a central compressor serving a series of exercise/rehabilitation pneumatic controlled resistance devices. The schematic representation of the pneumatic adjustable resistance pneumatic system is provided in FIG. 17.

Figure 19A:
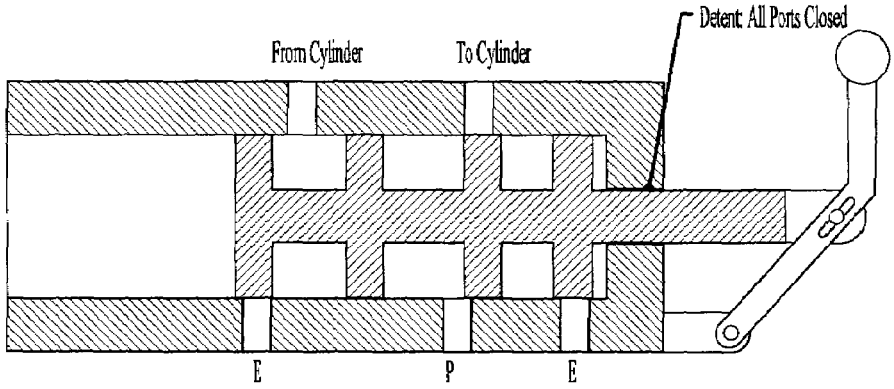
FIGS. 19A through 19C are graphic presentations of a 5/2 manually operated device control valve.
Figure 19B:
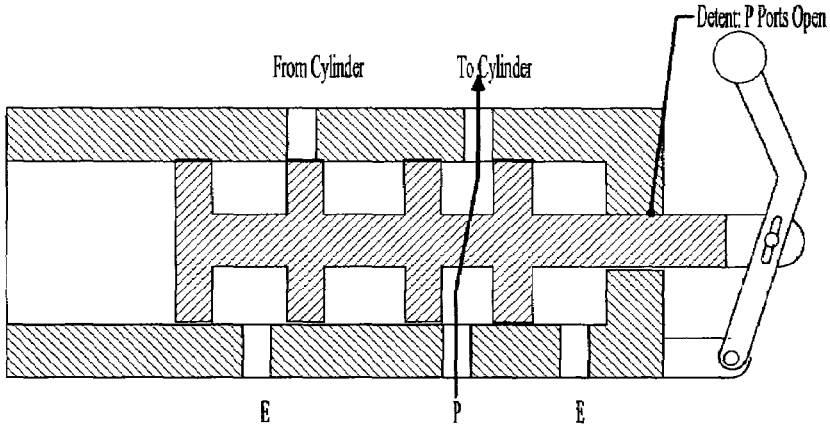
Figure 19C:
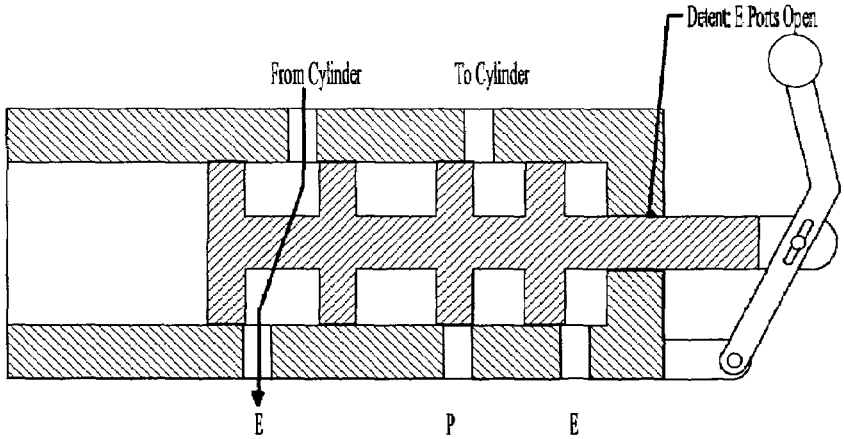

Control of both the hydraulic and pneumatic compressor driven systems may be optionally provided by a 5/2 flow control valve as depicted in FIGS. 19A through 19C or by dual 2/2 flow control valves.

Figure 5:
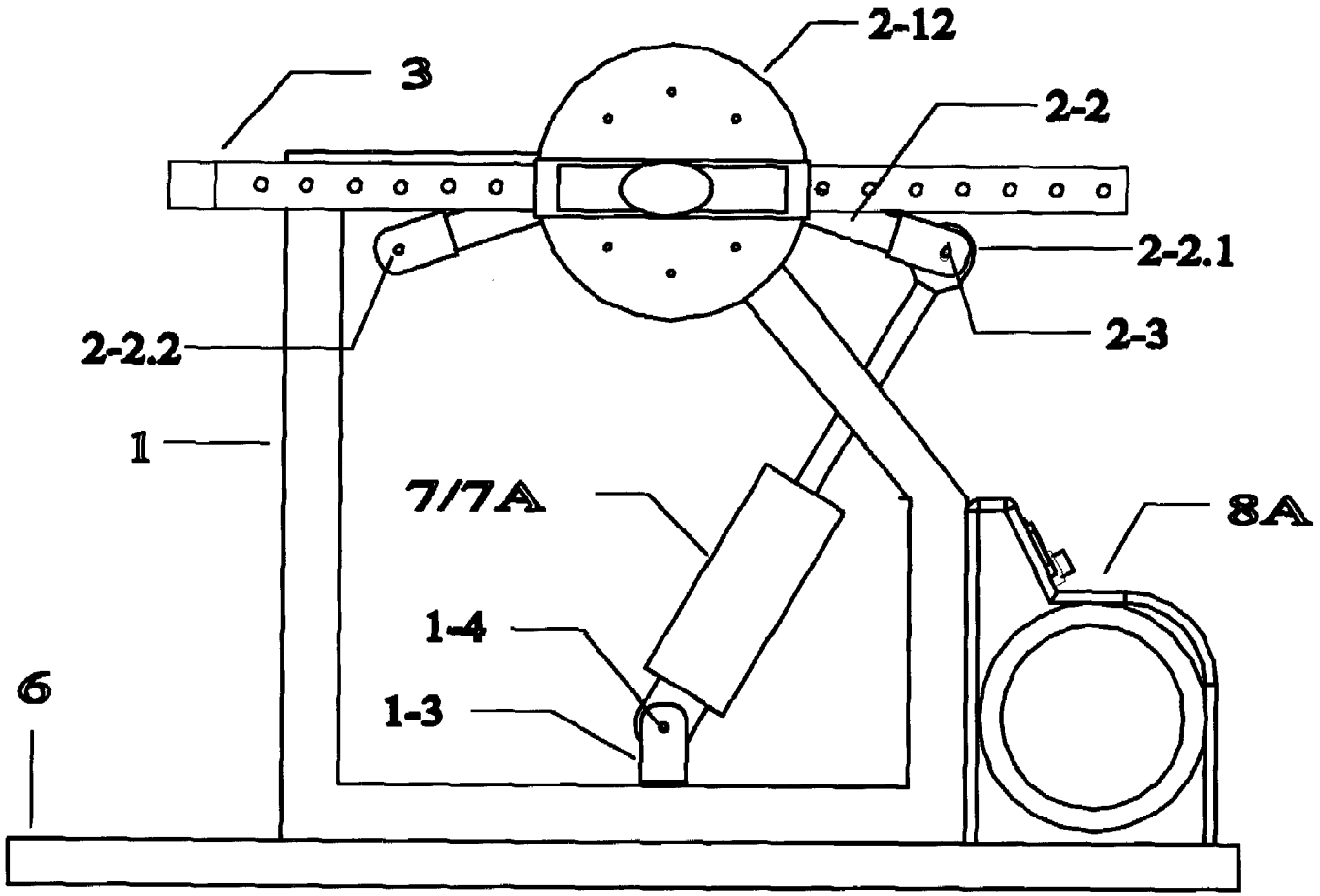
FIG. 5 is a side view of the Physical Rehabilitation and Fitness Exercise Device excluding the chair and track assemblies to depict both the pneumatic and hydraulic configurations.

Referring to FIG. 5 the hydraulic cylinder (7), or the pneumatic cylinder (7A), is detachably affixed to the main frame base cross bar clevis 1-3 and secured by a hitch pin 1-4. When the exercise arm 3 is positioned towards the front of the exercise device, the upper end of the cylinder piston arm is mated to the torsion bar lever 2-2 and secured to clevis 2-2.1 with hitch pin 2-4 for clockwise (lifting) motion of the exercise arm, or alternately secured with hitch pin 2-4 to clevis 2-2.2 for counter-clockwise (depression) of the exercise arm. When the exercise arm is positioned towards the rear of the exercise device, the cylinder is attached to clevis 2-2.1 for clockwise (depression) motion of the exercise arm, and alternatively, attached to clevis 2-2.2 for counter clockwise (lifting) motion of the exercise arm.

Figure 6:
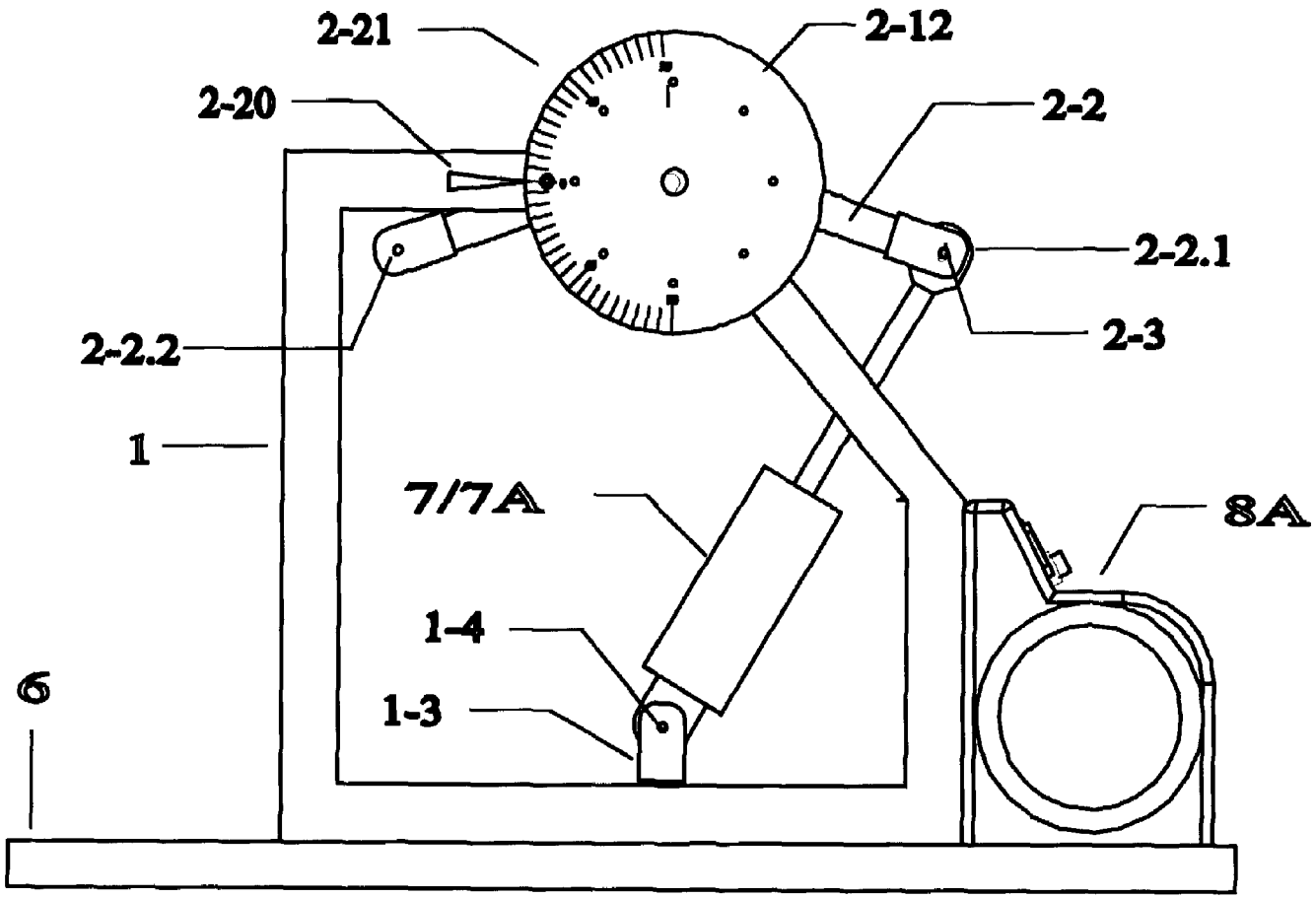
FIG. 6 is a side view of the Physical Rehabilitation and Fitness Exercise Device excluding the chair and track assemblies to depict the angular indexes inscribed on the platen surface (2-21) and the index maker (2-20) inscribed on the upper arm of the main frame.

In FIG. 6 platen 2-12 indexes 2-21, inscribed on the platen face, align with index marker 2-20 inscribed on the upper bar of the device frame. The indexes are incremented at 5° increments through 90° either side of the 0° index.

Figure 7:
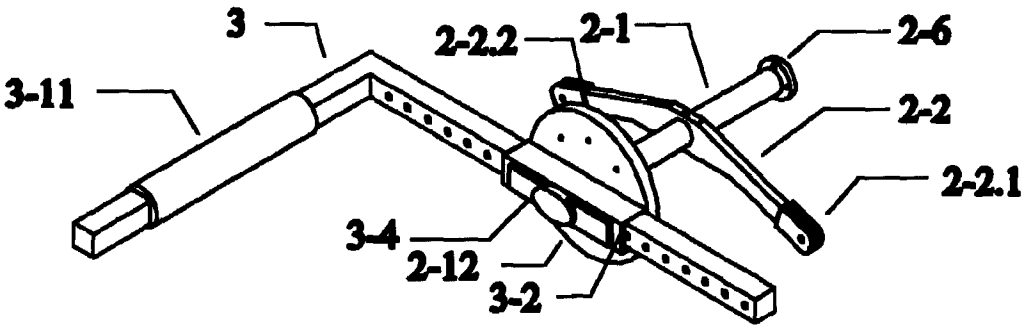
FIG. 7 is an oblique presentation of the exercise arm (3), torsion bar (2-1), lever (2-2), and the related subassemblies, which include the exercise arm pad (3-11).
Figure 8A:
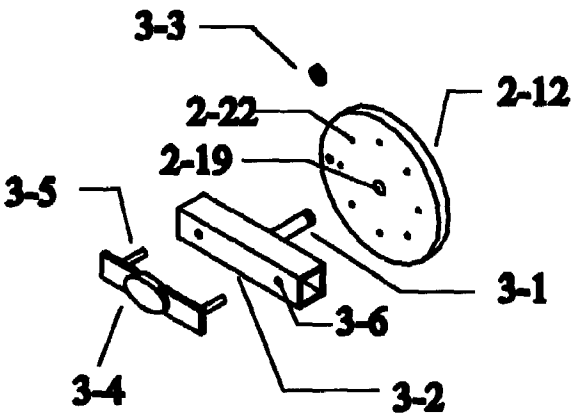
FIG. 8A is an exploded view of the platen (2-12) channeled square tubing (3-2) and locking key (3-4) subassembly.
Figure 8:
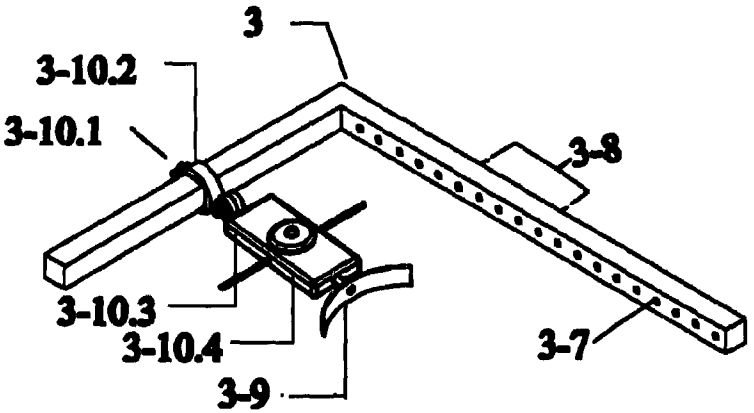
FIG. 8 is an oblique presentation of the exercise arm (3) with dynamometer (3-9), and an exploded view of the exercise arm mounting channel (3-2) locking key (3-4) and platen (2-12).

In FIGS. 7 and 8 exercise arm 3 fits, adjustably, within the exercise arm channel 3-2 and is locked in selected position by key 3-4 hitch pins 3-5 which fit through exercise arm channel ports 3-6, selected exercise arm ports 3-7 and into platen ports 2-22. Exercise arm subassembly shaft 3-1 is inserted through platen port 2-19 and locked in place by E Clip 3-3 to secure the exercise arm assembly to platen 2-12 (refer to FIG. 9 for a more detailed view of the platen profile).

Multiple ports 3-7 on exercise arm 3 allow adjusting the exercise arm to accommodate various user physical profiles as well as individual exercise regimens. Inscribed index lines 3-8, define the ports to mate with key 3-4 pins 3-5 to establish a point of equilibrium for a mechanical advantage of 1—wherein the functional length (from the center point of the torsion bar 2-1 to the cross member of the exercise arm) of the exercise arm is equal to the length of the torsion bar lever 2-2.

Decreasing the functional length of the exercise arm decreases the mechanical advantage (requiring more force to work against the preset resistance). Conversely, increasing the functional length of the exercise arm increases the mechanical advantage (requiring lesser force to work against the preset resistance).

Force levels required to work against preset pneumatic or hydraulic cylinder resistance forces can be calculated by the simple equation $F_e \times d_e = F_r \times d_r$ wherein the length of the lever ($d_r$) remains constant and the preset resistance ($F_r$) is defined. The functional length of the exercise arm ($d_e$) is measured from the exercise arm channel shaft (fulcrum) to the exercise arm cross bar. The force ($F_e$) required to work against the preset resistance may be verified by use of the dynamometer. Similarly the dynamometer may be used effectively to calibrate the pneumatic and/or hydraulic cylinder resistance settings.

End cap 2-8 is secured to the device frame by screws 2-10 threaded through end cap and frame holes 2-11

As defined in discussion of FIG. 8 and FIG. 8A above, the exercise arm 3, channel 3-2 and key 3-4 assembly and shaft 3-1 fits through platen bored hole 2-19 and is secured within the platen by E Clip 3-3.

Platen 2-12 hollowed shaft fits within the torsion bar bored hole 2-13 and is secured within the torsion bar with set screws 2-14 threaded through torsion bar ports 2-15 and platen ports 2-16.

Pin 2-17 fits through the upper arm of the frame hole 1-8 and platen port 2-18 to lock the platen and exercise arm assembly in place for isometric exercise regimens.

Holes 2-2.4 and 2-2.5 drilled through lever clevis 2-2.1 and clevis 2-2.2, respectively, accept pneumatic/hydraulic cylinder arm securing hitch pins 2-2.3.

Figure 11:
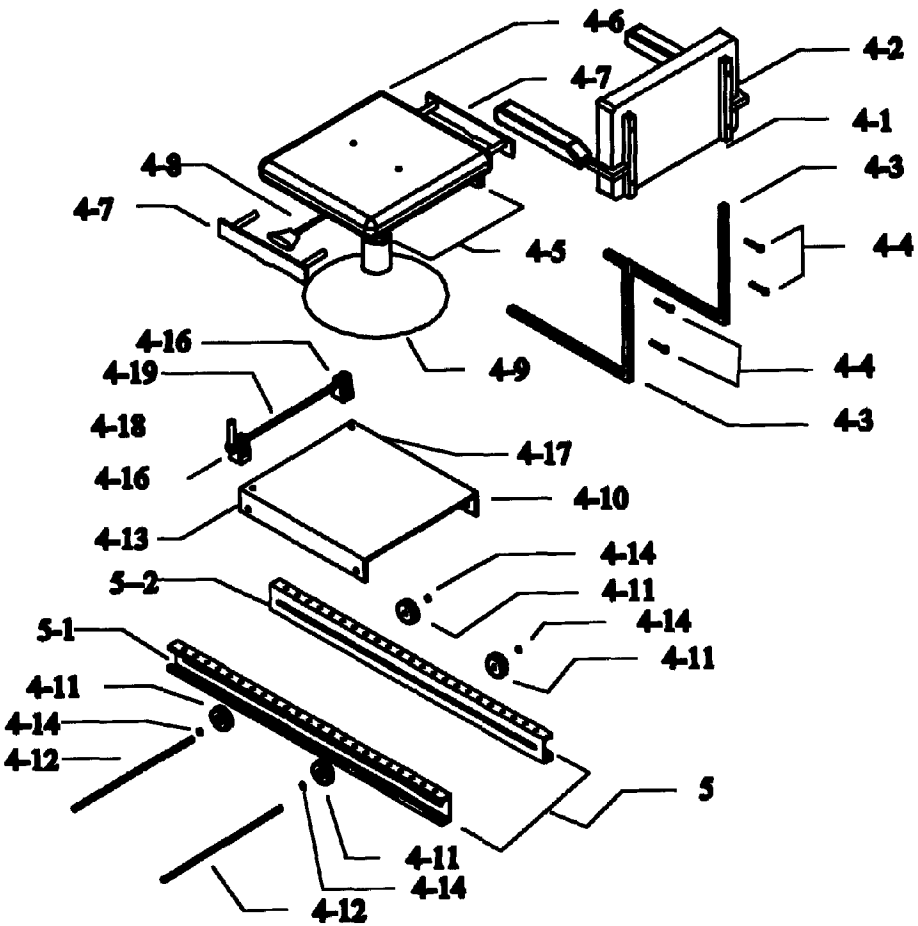
FIG. 11 is an oblique exploded view of the Chair and track assemblies.
Figure 12:
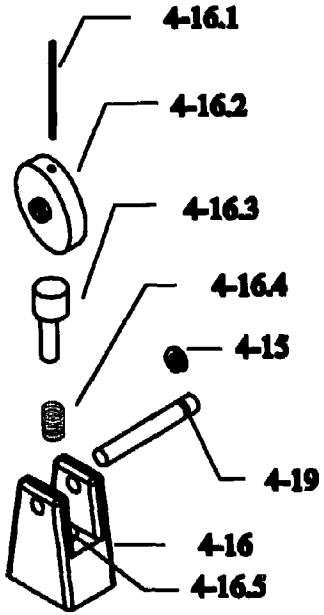
FIG. 12 is an oblique exploded view of the Chair Locking mechanism pylon(s).
Figure 13:
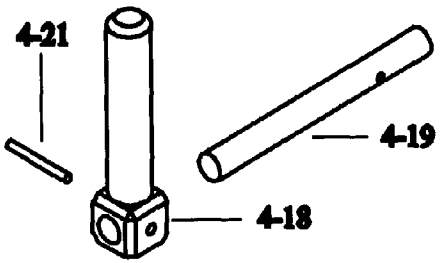
FIG. 13 is an oblique exploded view of the seat lock handle assembly.

FIGS. 11, 12 and 13 depict the adjustable seat assembly 4 and tracks 5. Seat Back assembly 4-2 consists of arm assemblies 4-1 permanently attached to 'L' shaped seat back supports 4-3. The arm assemblies and 'L' shaped supports are secured to seat back by bolts (or other type of adequate fasteners) 4-4. The 'L' shaped back supports fit into parallel channels 4-5 affixed to the base of the seat cushion 4-6 and are detachably secured to the seat cushion channels with keys hitch pins 4-7. Standard off-the-shelf pneumatic seat adjustment hardware and activation lever 4-8 are mounted to a chair base 4-9. This subassembly is permanently affixed to platform 4-10.

Four (4) wheels 4-11 fit within the parallel tracks' channels 5.1 to align with the platform ports 4-13. Axles 4-12 are passed through wheels 4-11, platform ports 4-13 and track slots 5-2 and are secured with E-Clips 4-14.

Padded sleeve 3-11 (FIG. 7), composed of hi density foam rubber encased in a hypoallergenic polyvinyl type material, is detachably affixed to the exercise arm to provide a gripping surface as well as padded protection for leg exercises.

Dynamometer 3-9 (FIG. 8) is detachably affixed to the exercise arm using articulated jig 3-10 consisting of clamp screw 3-10.1 which screws against exercise arm 3 to secure the jig's upper arm 3-10.2 to the exercise arm, nut 3-10.3 which is applied to threaded extension of jig body 3-10.4 to allow the jig body to be articulated as required to provide perpendicular and/or tangential aligned application of forces during prescribed exercise routines.

Figure 9:
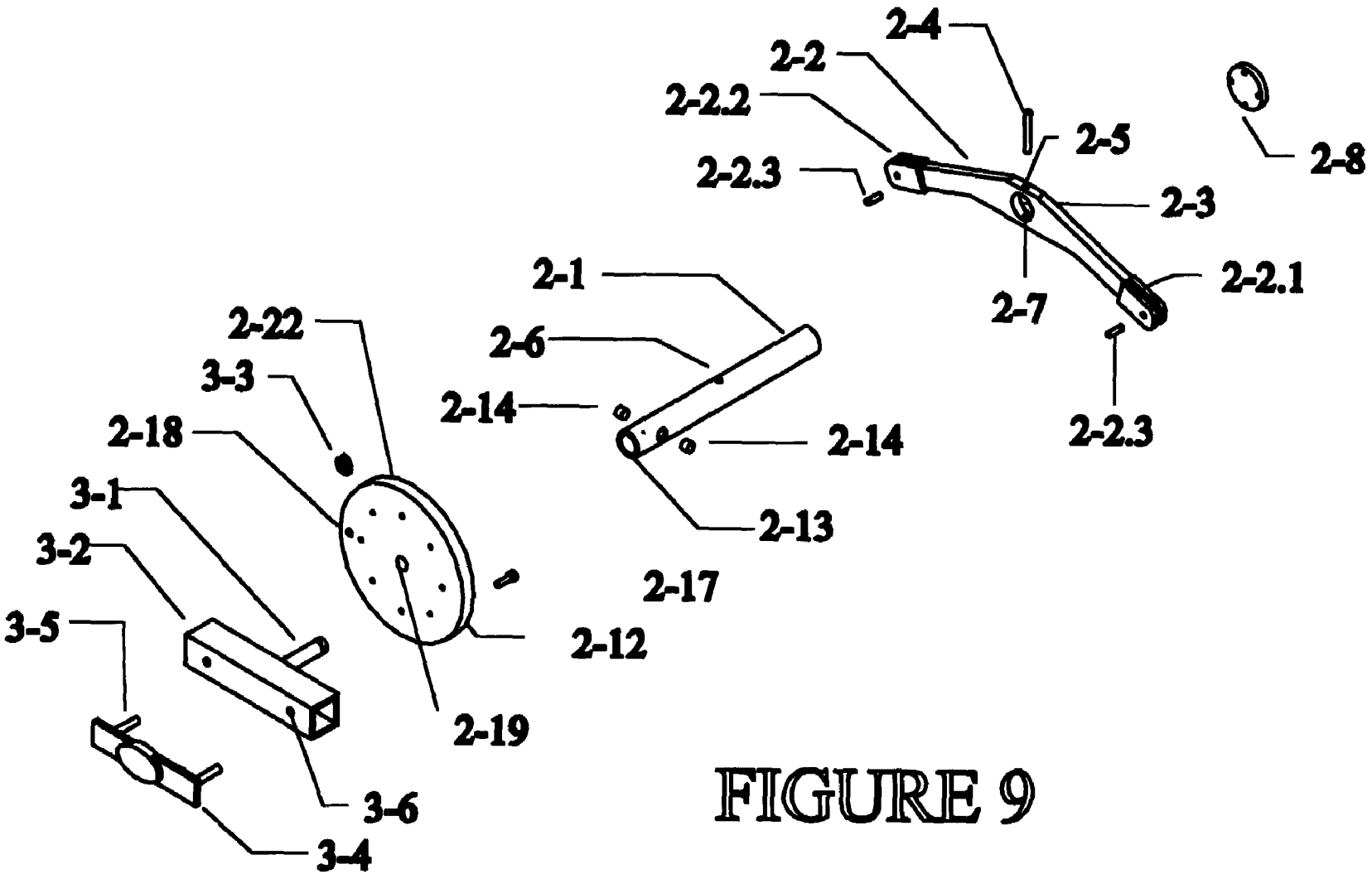
FIG. 9 is an exploded view of the Physical Rehabilitation and Fitness Exercise Device torsion bar and lever assembly.
Figure 10:
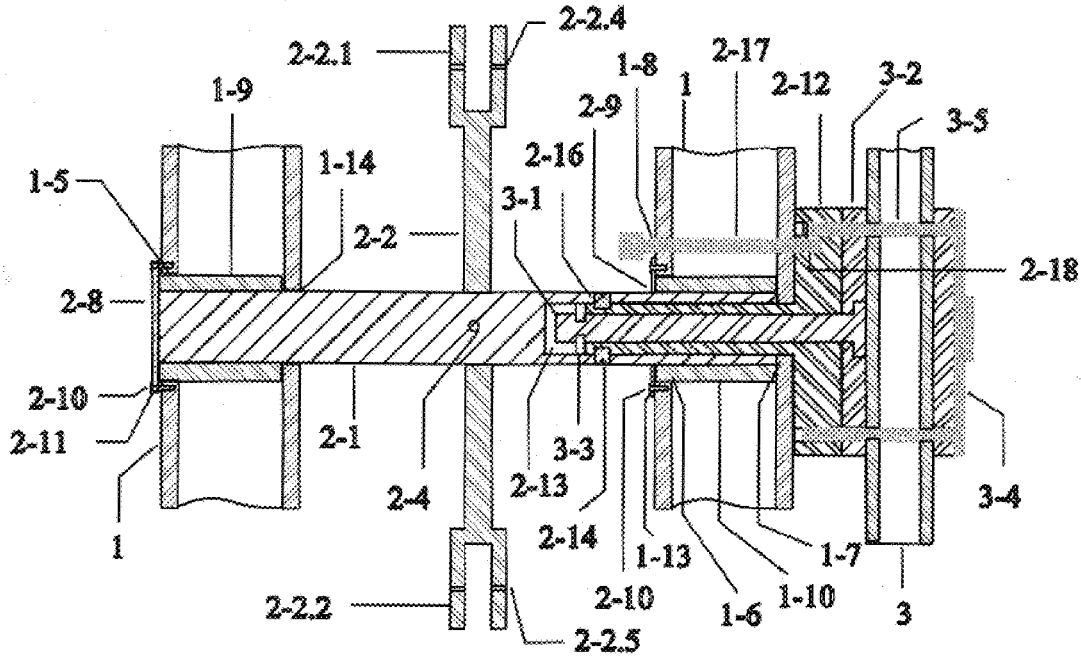
FIG. 10 is a cross section orthographic view of the torsion bar and lever and exercise arm subassemblies.

For clarity, the torsion bar subassembly components are depicted in both FIG. 9 which presents an exploded view of the torsion bar components and FIG. 10 which provides a cross-sectional view of the assembly. Bearings 1-9 and 1-10 fit within the Rehabilitation and Exercise Device frame 1 through bored holes 1-5 and 1-6 and are secured to the frame with four (4) set screws 1-1 and 1-2 (as defined in discussion on FIG. 2). Bearing 1-10 is further secured within the frame by retaining plate 2-9 which is attached to the frame with screws 2-10 threaded through frame holes 1-13.

Torsion bar 2-1 fits through bearing 1-9 and the rear upper arm frame hole 1-14. Lever 2-2 hole 2-3 fits over the torsion bar and is secured in place by threaded pin 2-4 through lever hole 2-5 into torsion bar hole 2-6 and screwed into lever threaded hole 2-7. The torsion bar then fits through the retaining plate 2-9, front bearing 1-10 and abutted against frame wall at point 1-7.

Seat lock assembly pylons 4-16 are permanently affixed to platform 4-10 to align the pylon locking pin 4-16.3 with platform ports 4-17. The locking pins fit through coil springs 4-16.4 and the pylons' counter-bored holes 4-16.5. Pylon cams 4-16.2 positioned over the locking pins are detachably affixed to the pylon by the locking assembly activating rod 4-19 and secured to the activating rod by pin 4-16.1. The locking assembly handle 4-18 is detachably affixed to the activating rod by pin 4-21. E-Clip 4-15 detachably secures the activation rod to the pylon assembly. When the handle is turned clockwise, the pylon cams press the locking pins downward through the selected track ports 5-3. When the handle is rotated counterclockwise the pylon cams release pressure on the locking pins and the coil springs force the locking pins upward unlocking the seat assembly.

Figure 14:
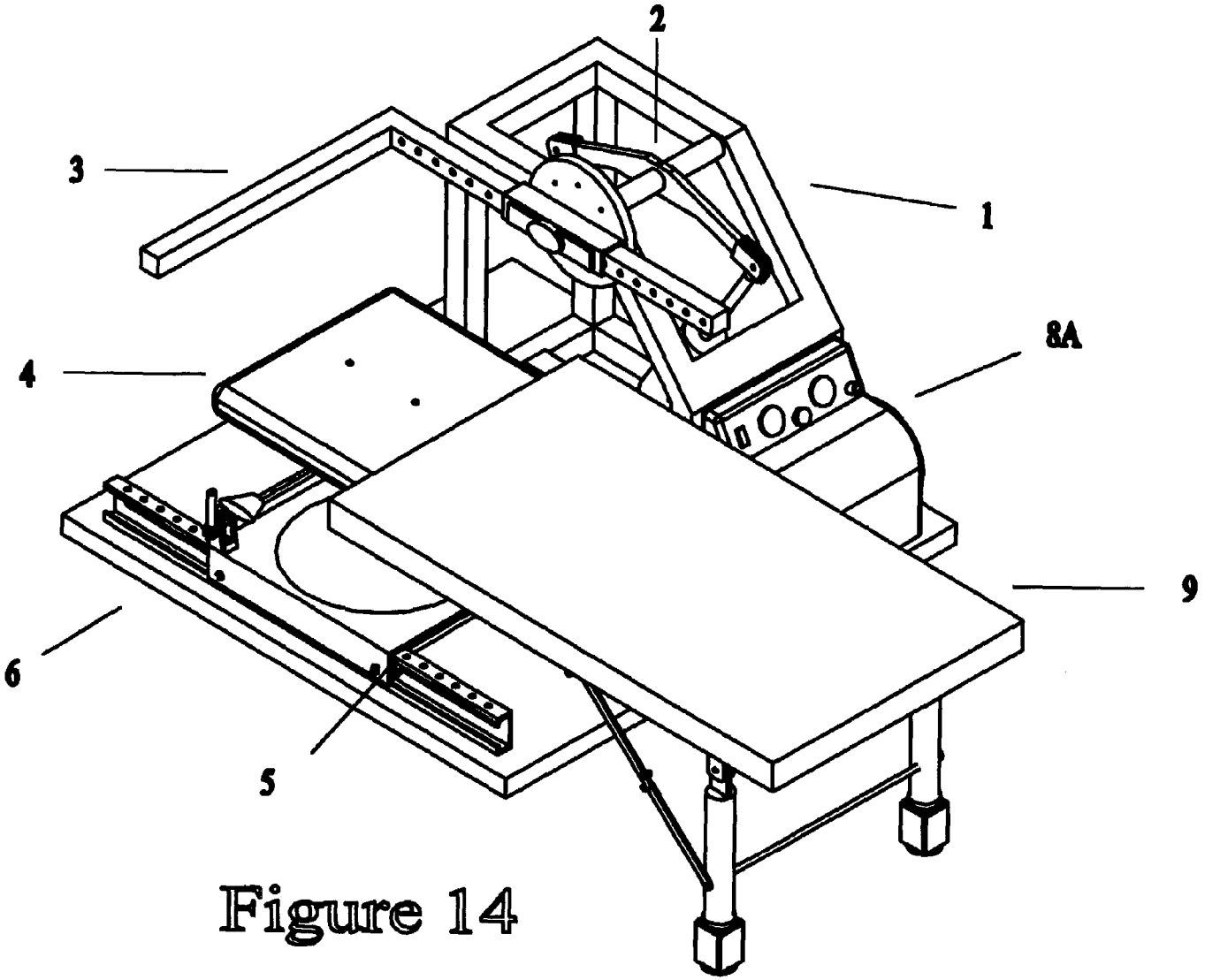
FIG. 14 is an oblique view of the Physical Rehabilitation and Fitness Exercise Device with the chair back removed and the plinth (9) installed.

Removing seat back assembly 4-2 and 'L' shaped back supports 4-3 from the seat assembly allows installation of the plinth assembly 9, as depicted in FIG. 14, to reconfigure the Physical Rehabilitation and Exercise Devise for exercise regimens which require the user to be in the supine or prone position. The plinth assembly 9 may be installed from either end of the seat base 4-6 depending on the specified rehabilitation or exercise regimen. The seat base 4-6 may also be rotated 90° to position the patient/exerciser perpendicular to the exercise device for lateral motion of arm and shoulder exercises.

Figure 15:
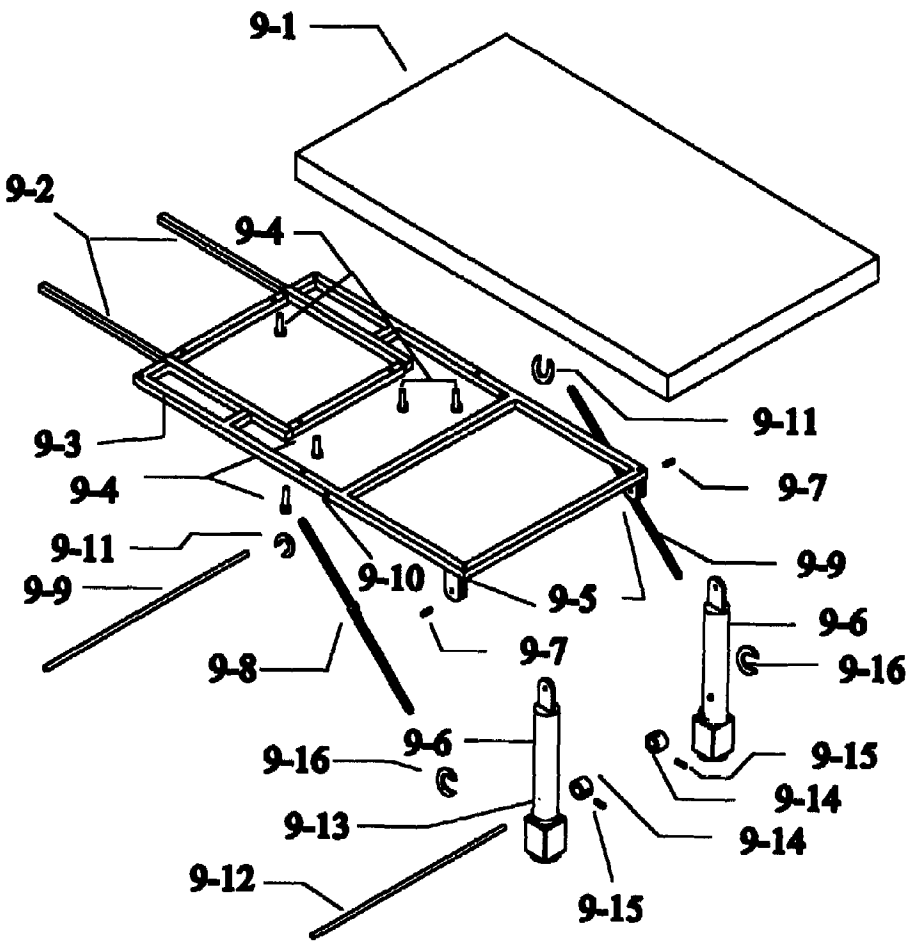
FIG. 15 is an oblique exploded view of the plinth assembly.
Figure 16:
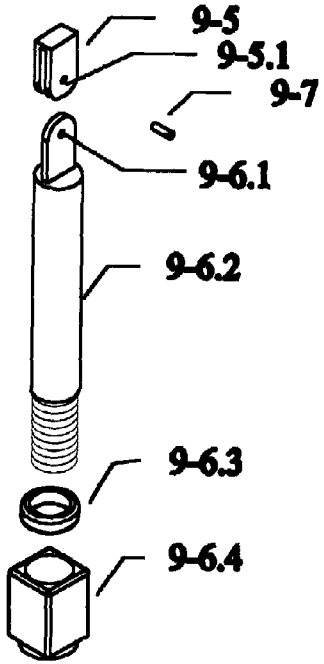
FIG. 16 is an oblique exploded view of the plinth leg.
Figure 17:
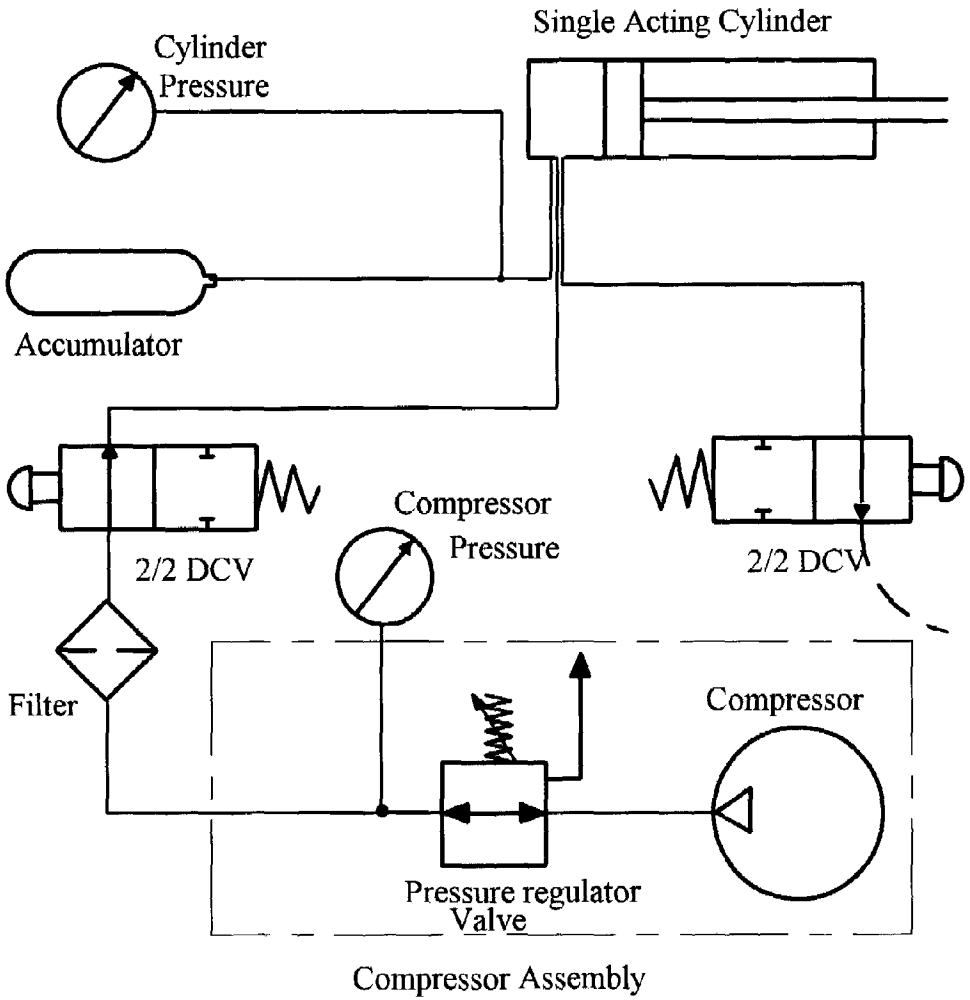
FIG. 17 is a schematic view of the typical pneumatic cylinder adjustable resistance assembly.
Figure 18:
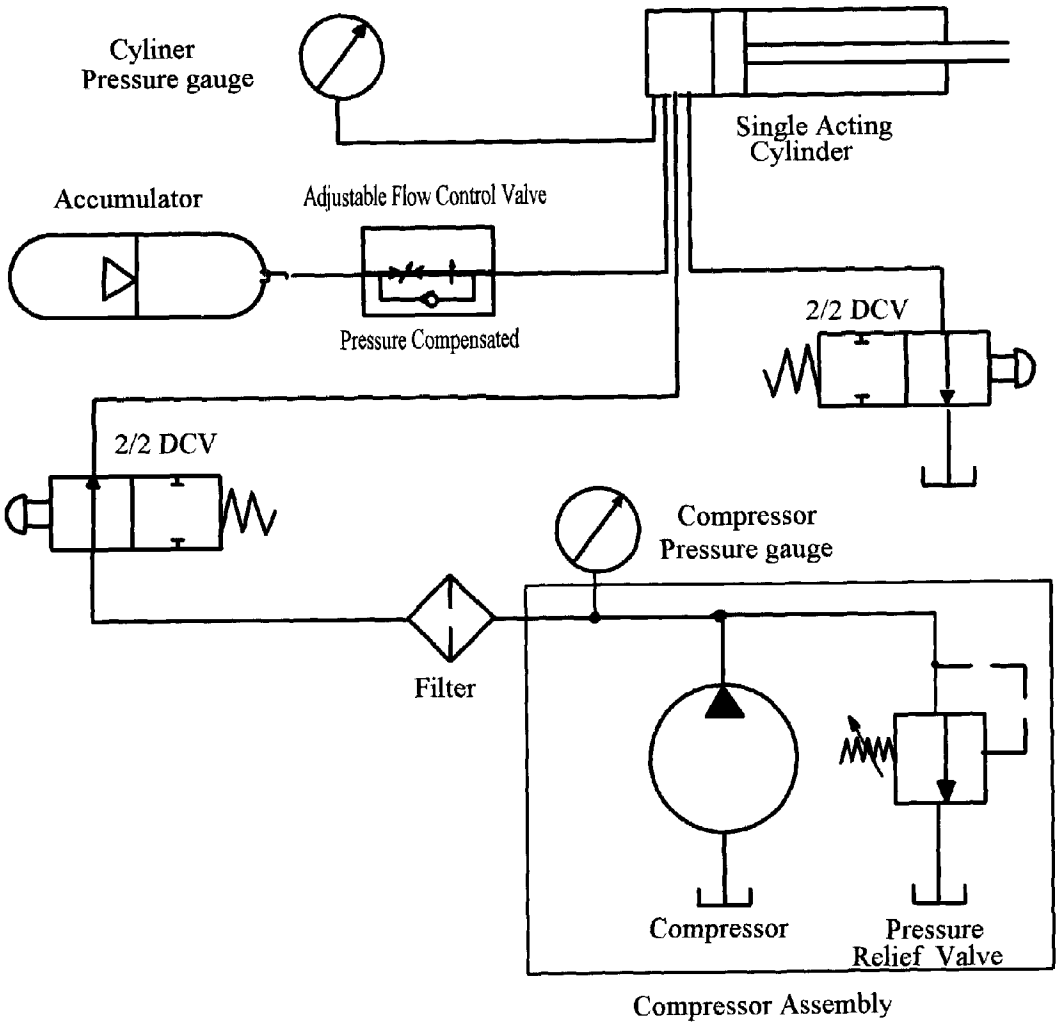
FIG. 18 is a schematic view of the typical compressor driven hydraulic cylinder adjustable resistance assembly.

Referring to FIGS. 14, 15 and 16, plinth frame extensions 9-2 fit within the seat's parallel channels 4-5 and secured with keys hitch pins 4-7. The plinth pad 9-1, composed of a firm base board and hi density foam rubber encased in a hypoallergenic polyvinyl type material, is detachably affixed to the plinth frame 9-3 with bolts (or other type suitable fasteners) 9-4.

Two (2) plinth adjustable legs 9.6 are connected to the plinth frame at clevis 9-5 and secured with pins 9-7 through adjustable legs' ports 9-6.1 and clevis ports 9-5.1. Rod 9-12 passes through adjustable legs' ports 9-13 and locking rings 9-14. Pins 9-15 secure the locking rings to rod 9-12 to maintain parallel separation of the plinth adjustable legs.

Rod 9-9 fits through frame ports 9-10 and is the anchor for support hinges 9-8. The support hinges and rod are secured to the plinth frame with E-Clips 9-11. The opposite end of the support hinges, which allow the plinth adjustable legs to be collapsed for storage, are anchored on rod 9-12 and secured to the rod with E-Clips 9-16.

Referring to FIG. 16 each plinth adjustable leg cylindrical body 9-6.2 has its base end threaded to accommodate the threaded locking rings 9-6.3 and threaded leg bases 9-6.4. Each threaded leg base is screwed upwards or downwards to level the plinth pad and the locking ring is screwed downward against the leg base to lock the leg base in place.

Application of this rehabilitation and exercise device to both the physical therapy and physical fitness provide both flexor and extensor exercise profiles as depicted in, but not limited to, the profiles in the following figures.

Figure 20A:
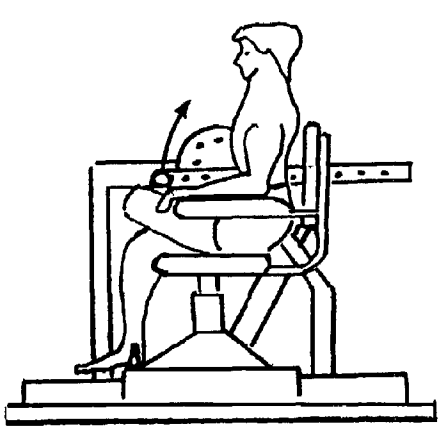
FIG. 20A is a physical profile of a patient/exerciser (amputee) performing hip flexion and extension from a sitting position.

FIG. 20A depicts hip flexion with the resistance cylinder rod connected to the right lever clevis and the patient/exerciser moving the exercise lever in a clockwise direction. Hip extension is achieved by reconnecting the resistance cylinder rod to the left lever clevis and the patient/exerciser moving the exercise lever in a counterclockwise direction.

Figure 20B:
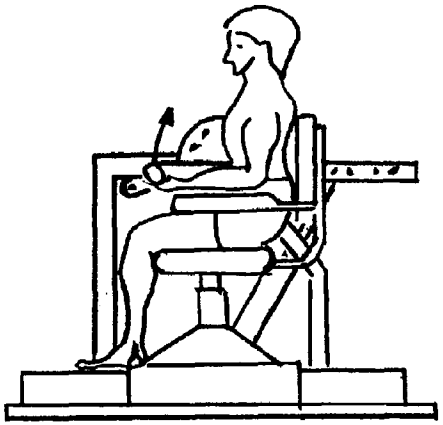
FIG. 20B is a physical profile of a patient/exerciser performing elbow flexion and extension from a sitting position.

FIG. 20B depicts elbow flexion with the resistance cylinder rod connected to the right lever clevis and the patient/exerciser moving the exercise lever in a clockwise direction. Elbow extension is achieved by repositioning the exercise arm to a higher angle on the platen, reconnecting the resistance cylinder rod to the left lever clevis and moving the exercise arm in a counterclockwise direction.

Figure 20C:
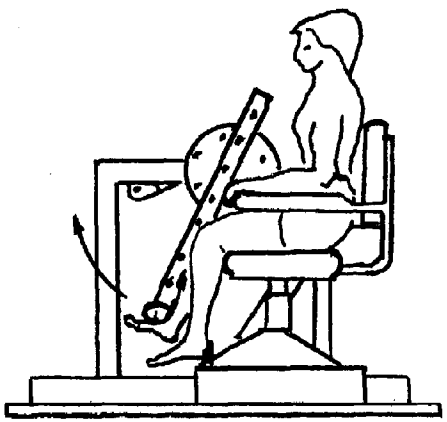
FIG. 20C is a physical profile of a patient/exerciser performing ankle dorsi flexion and plantar flexion from a sitting position.

FIG. 20C depicts ankle dorsi flexion with the resistance cylinder rod connected to the right lever clevis and the patient/exerciser moving the exercise arm in a clockwise direction. Plantar flexion is achieved by repositioning the exercise arm to a higher angle on the platen, reconnecting the resistance cylinder rod to the left lever clevis and moving the exercise arm in a counterclockwise direction.

Figure 20D:
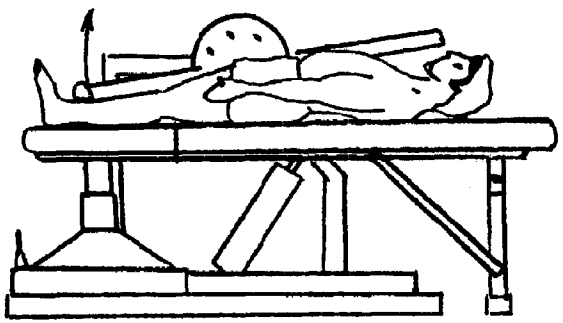
FIG. 20D is a physical profile of a patient/exerciser performing hip abduction from a supine position.

FIG. 20D depicts hip flexion, in a supine position, with the resistance cylinder connected to the right lever clevis and rotating the exercise arm in a clockwise direction. Hip extension, in the supine position, is achieved by repositioning the exercise arm to a higher angle on the platen, reconnecting the resistance cylinder rod to the left lever clevis and moving the exercise arm in a counterclockwise direction.

Figure 20E:
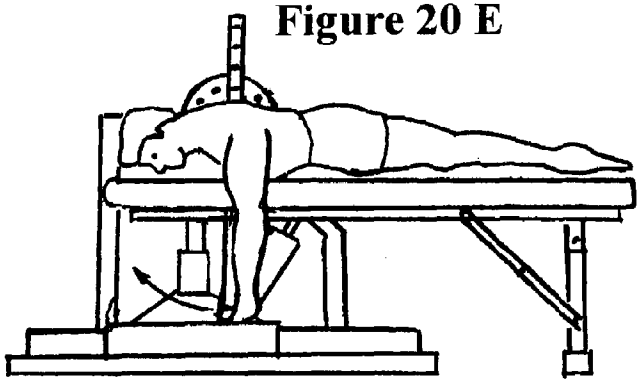
FIG. 20E is a physical profile of a patient/exerciser performing shoulder flexion and extension from a prone position.

FIG. 20E depicts shoulder flexion with the resistance cylinder connected to the right lever clevis and rotating the exercise arm in a clockwise direction. Shoulder extension is achieved by repositioning the resistance cylinder rod to the left lever clevis and moving the exercise arm in a counterclockwise direction.

We claim:

1. An adjustable resistance physical rehabilitation and fitness exercise device comprising:

a) a frame assembly for affixing to a platform comprising:

i) forward and rearward irregular pentagonal uprights, each pentagonal upright consisting of two base angles and one upper vertex angle of 90° and a biased construction of the fifth leg of said pentagonal upright, and wherein said forward and rearward pentagonal upright are connected at each vertex with crossbars to form a three dimensional rectangular tower;

ii) aligned machined ports having respective horizontal centerlines in oppositely disposed forward upper horizontal arm and rearward upper horizontal arm of said forward and rearward pentagonal uprights, respectively, within which friction reduction bearings are secured;

iii) an index marker in line with said horizontal centerline of said machined port affixed to a frontal face of said forward upper horizontal arm of said pentagonal upright;

iv) a bored port through said forward upper horizontal arm of said forward pentagonal upright oppositely disposed, along said machine port horizontal centerline, from said index marker to receive a locking pin to secure said adjustable lever assembly in place to facilitate isometric exercise regimens; and v) a bar longitudinally attached at the base of said frame assembly equidistant from oppositely disposed pentagonal uprights, said bar further comprising a clevis attached centrally on the upper surface thereof;

b) an adjustable lever assembly having an axial centerline and being operatively connected to said frame assembly for movement by a user in clockwise and counterclockwise rotation about a fixed axis to perform specified exercise regimens;

c) adjustable resistance controlled flow means to provide predetermined levels of resistance against movement of said lever assembly; and d) an adjustable seat and track assembly, operatively slidably and swivably connected to said frame assembly, for positioning said user in respect to the axial centerline of said lever assembly to perform predetermined exercise regimens.

2. The adjustable resistance physical rehabilitation and fitness exercise device, as defined in claim 1, wherein said adjustable lever assembly comprises means to longitudinally adjust leverage ratios, said adjustment means comprising:

i) an L-shaped exercise arm having equally spaced ports through the proximal arm;

ii) a channeled square tubing containing ports spaced coincident to the spacing of ports on the exercise arm for adjustment of exercise arm length;

iii) a quick release hitch type pin assembly comprising two hitch pins and a base bar, wherein said hitch pins are spaced apart and secured to said base bar coincident to the spacing of said exercise arm ports; and iv) a substantially solid rod, having a necked recess machined at the distal end thereof, permanently affixed and centered on the back side of said channeled square tubing.

3. The adjustable resistance physical rehabilitation and fitness exercise device, as defined in claim 2, further comprising means to adjust and secure said exercise arm radially on the vertical plane, said means comprising:

i) a platen configured with a hollow shaft, having an inside diameter, compatible with said substantially solid rod of said channeled square tubing, and having a length equivalent to the length of said substantially solid rod from its base to its said necked recess, to accept the means to secure said exercise arm and channeled square tubing;

ii) a series of ports spaced equally along a circumference wherein the spacing between oppositely disposed ports is equivalent to the spacing of ports on said exercise arm, said channeled square tubing and said quick release hitch type pin assembly;

iii) a machined port through the platen on its horizontal centerline to coincide with said machined port in said upper horizontal arm of said forward pentagonal upright;

iv) angular displacement indexes on said platen's edge and facing ranging from 0 degrees through 90 degrees either side of said index marker;

v) quick release means to secure said platen in place aligning said frame index marker with said platen 0 degree index; and vi) a plurality of machined ports, equally spaced around said platen hollow shaft, bored partially into walls thereof to accept threaded means to mate and secure said platen and exercise arm assembly to a torsion bar.

4. The adjustable resistance physical rehabilitation and fitness exercise device, as defined in claim 1, wherein said adjustable lever assembly further comprising a torsion bar mounted to said frame assembly through said friction reduction bearings, said torsion bar further comprising:

i) a hole bored longitudinally into the proximal end of the torsion bar wherein said hole diameter is compatible with said platen's said hollow shaft outside diameter, and wherein depth of said hole is sufficiently deep to accommodate the length of said square channel tubing solid rod; and ii) threaded ports equally spaced around said torsion bar and positioned to thread retaining screws into said platen said hollow shaft bored ports to secure said platen, said square channel tubing and said exercise arm assembly within said torsion bar.

5. The adjustable resistance physical rehabilitation and fitness exercise device, as defined in claim 4, wherein said adjustable lever assembly further comprising a lever, configured with a clevis at each end, and a port situated between lever ends for mounting and securing said lever to said torsion bar at a midpoint between said forward and rearward pentagonal frame uprights.

6. The adjustable resistance physical rehabilitation and fitness exercise device, as defined in claim 1, wherein said adjustable resistance controlled flow means comprises a cylinder having means for detachably and pivotably affixing said cylinder to said frame base clevis, and further comprises an integral piston and a rod, to slidably move within said cylinder, said piston and rod having means for detachably and pivotably affixing said piston and rod end to selected said lever clevis to accommodate a predetermined exercise regimen.

7. The adjustable resistance physical rehabilitation and fitness exercise device as defined in claim 6, wherein said adjustable resistance controlled flow means further comprising a pneumatic compressor and control means to provide and maintain controlled levels of pneumatic pressure forces to resist said user's repetitive clockwise and counterclockwise iterative rotations of said exercise arm for predetermined exercise routines.

8. The adjustable resistance physical rehabilitation and fitness exercise device, as defined in claim 7, wherein said adjustable resistance controlled flow means further comprising:

i) an air reservoir connected in line, by pneumatic conduit, to said pneumatic cylinder;

ii) pressure indicator means connected in line, by said pneumatic conduit, between said pneumatic cylinder and said air reservoir;

iii) an user activated directional control valve means connected by pneumatic conduit between said pneumatic compressor and said pneumatic cylinder for delivery and maintenance of said pneumatic gases, at said user defined levels of pressure, from said pneumatic compressor to said pneumatic cylinder and said air reservoir; while restricting pneumatic gases from returning to said pneumatic compressor; and iv) an user activated directional control valve connected by pneumatic conduit to said pneumatic cylinder to reduce, or alternatively filly discharge, pressure levels within said pneumatic cylinder and said air reservoir.

9. The adjustable resistance physical rehabilitation and fitness exercise device as defined in claim 6, wherein said adjustable controlled flow means alternatively comprising an hydraulic compressor and control means to provide and maintain controlled levels of hydraulic pressure forces to resist said user's repetitive clockwise and counterclockwise iterative rotations of said exercise arm for predetermined exercise routines.

10. The adjustable resistance rehabilitation and fitness exercise device, as defined in claims 9, wherein said adjustable controlled flow means further comprising:

i) a hydraulic reservoir connected to said hydraulic compressor by hydraulic conduit;

ii) an accumulator connected in line, by said hydraulic conduit, between said compressor and said hydraulic cylinder;

iii) a pressure indicator means connected in line by said hydraulic conduit, between said hydraulic cylinder and said accumulator;

iv) a pressure compensated flow control valve situated in line between said hydraulic cylinder and said accumulator; wherein the hydraulic oils pressure from said hydraulic cylinder to the accumulator is metered to provide controlled flow of hydraulic oils within a specified pressure envelope;

v) a user activated directional control valve connected by hydraulic conduit between said hydraulic compressor to said hydraulic cylinder for delivery and maintenance of pneumatic oils, at said user defined levels of pressure, from said hydraulic compressor to said hydraulic cylinder and said accumulator while restricting hydraulic oils from returning through said compressor to said reservoir;

vi) a user activated directional control valve means to permit said user to reduce pressure levels within the adjustable controlled flow system or alternatively filly discharge the pressure from said hydraulic cylinder and said accumulator.

11. The adjustable resistance physical rehabilitation and fitness exercise device, as defined in claim 1, wherein said adjustable resistance control means optionally Consists of a commercially available self contained adjustable resistance hydraulic cylinder wherein the hydraulic oil reservoir, adjustable resistance means and flow control means are integral elements of said adjustable resistance hydraulic cylinder.

12. The adjustable resistance physical rehabilitation and fitness exercise device, as defined in claim 1, wherein said adjustable seat and track assembly further comprises:

i) a set of open faced channeled tracks affixed to the exercise platform and said tracks further consisting of a series of equally space ports on the upper surface of each track and a longitudinal keyway along the back section of each track; and ii) a seat assembly comprising means for vertical, lateral and rotational adjustment and positioning of seating platform to conform to specific exercise regimens.

13. The adjustable resistance physical rehabilitation and fitness exercise device, as defined in claim 12, wherein said seat assembly further comprises the means to adjustably position the seat assembly vertically as well as horizontally to conform to individual user profiles and exercise regimens wherein the seat assembly further comprises:

a) a pressurized pillar means to allow vertical adjustment of seat height;

b) lever means to activate said pressurized pillar means for vertical seat adjustment and rotation;

c) a base platform comprising wheels and axles wherein said wheels are enclosed within said track channels and rotationally secured to the seat assembly by axles inserted through said wheels, said platform and each said track's longitudinal keyway;

e) parallel channels with spaced ports attached to underside of the seat cushion and a removable seat back and armrest assembly wherein said assembly tongues are detachably secured to said channels by hitch type pin assemblies; and f) a seat assembly locking means comprising a lever activated set of spring loaded locking pins situated within pylons affixed to said seat platform and aligned with ports on the upper surface of each track.

14. The adjustable resistance physical rehabilitation and fitness exercise device, as defined in claim 13 wherein said seat assembly further comprising: a lay-in platform to accommodate user's performing predetermined prone position exercise regimes. Said platform a plinth, further comprising:

i) parallel channels with spaced ports attached to underside of the seat cushion and a removable seat back and armrest assembly wherein said assembly tongues are detachably secured to said channels by hitch type pin assemblies; and ii) a detachably affixed lay-in platform to accommodate user's performing predetermined prone position exercise regimes.

15. The adjustable resistance physical rehabilitation and fitness exercise device, as defined in claim 14, wherein said lay-in platform further comprising:

i) a square tubular frame having parallel tongues and spaced ports, at the proximal end, coincident with said channel and port spacing of said seat cushion channels;

ii) a hypo-allergenic surface pad with stiff backing detachably affixed to a said square tubular frame;

iii) legs, pivotably and detachably affixed to oppositely disposed sides at the distal end of said plinth square tubular frame;

iv) scissor type hinges collapsably and pivotably affixed oppositely disposed sides of said square tubular frame and said plinth legs to allow rotation and locking of said legs in the stowed and alternately the extended position; and v) cross bar and spacers through lower sections of said legs to maintain parallel relationship between said legs.

16. The legs of the detachably affixed platform, as define in claim 15, further comprise:

i) threaded means at he distal ends of said legs;

ii) threaded hollow end caps, threaded to sufficient depths to permit reasonable adjustment of each leg to provide stability and leveling of said plinth, when mounted to said seat assembly, when said legs are extended; and iii) threaded locking rings for threading against said hollow caps for locking said leg length at set heights to mate in line with said adjustable seat and track assembly.

17. The adjustable resistance physical rehabilitation and fitness exercise device, as defined in claim 2, wherein said exercise arm further comprising a detachably affixed articulated jig mounted force measurement means to:

i) calibrate said pressure indicator and measure levels of resistance derived from predetermined exercise regimens;

ii) measure levels of resistance encountered by said user during predetermined isometric exercise routines.

18. The adjustable resistance physical rehabilitation and fitness exercise device, as defined in claim 17, wherein said exercise arm further comprising a detachably affixed padding to protect said user from stresses and injury, when pressing against said exercise arm, during predetermined stress related exercise regimens.

* * * * *